US008087260B2

(12) United States Patent
Ogata et al.

(10) Patent No.: US 8,087,260 B2
(45) Date of Patent: Jan. 3, 2012

(54) FLUID MACHINE AND REFRIGERATION CYCLE APPARATUS

(75) Inventors: Takeshi Ogata, Osaka (JP); Takumi Hikichi, Osaka (JP); Atsuo Okaichi, Osaka (JP); Masaru Matsui, Kyoto (JP); Hiroshi Hasegawa, Osaka (JP)

(73) Assignee: Panasonic Corporation, Osaka (JP)

( * ) Notice: Subject to any disclaimer, the term of this patent is extended or adjusted under 35 U.S.C. 154(b) by 565 days.

(21) Appl. No.: 12/376,365

(22) PCT Filed: Jan. 16, 2008

(86) PCT No.: PCT/JP2008/050403

§ 371 (c)(1),
(2), (4) Date: Feb. 4, 2009

(87) PCT Pub. No.: WO2008/087958

PCT Pub. Date: Jul. 24, 2008

(65) Prior Publication Data

US 2010/0236275 A1 Sep. 23, 2010

(30) Foreign Application Priority Data

Jan. 18, 2007 (JP) ..... 2007-009498

(51) Int. Cl.
*F25D 9/00* (2006.01)

(52) U.S. Cl. ..... 62/401; 62/402

(58) Field of Classification Search ..... 62/401, 62/402, 403, 87; 418/125, 144, 167, 200; 417/310, 410.3; 60/485, 712
See application file for complete search history.

(56) References Cited

U.S. PATENT DOCUMENTS

| | | | | |
|---|---|---|---|---|
| 4,235,079 | A * | 11/1980 | Masser | 62/87 |
| 4,328,684 | A * | 5/1982 | Leo | 62/402 |
| RE31,379 | E * | 9/1983 | Shaw | 417/310 |
| 4,715,666 | A * | 12/1987 | Farr | 303/116.4 |
| 5,775,883 | A * | 7/1998 | Hattori et al. | 417/310 |
| 6,290,472 | B2 * | 9/2001 | Gannaway | 417/371 |
| 6,910,872 | B2 * | 6/2005 | Cho et al. | 418/60 |
| 6,929,455 | B2 * | 8/2005 | Dreiman et al. | 417/410.3 |
| 7,128,540 | B2 * | 10/2006 | Tadano et al. | 417/410.3 |
| 7,896,627 | B2 * | 3/2011 | Okamoto et al. | 418/13 |
| 2007/0053782 | A1 * | 3/2007 | Okamoto et al. | 418/30 |

FOREIGN PATENT DOCUMENTS

| | | | |
|---|---|---|---|
| EP | 1 918 510 | A1 | 5/2008 |
| JP | 62-077562 | A | 4/1987 |
| JP | 2005-264829 | A | 9/2005 |
| JP | 2006-105564 | A | 4/2006 |
| WO | WO 2006/112168 | A1 | 10/2006 |
| WO | WO 2007/000854 | A1 | 1/2007 |

* cited by examiner

*Primary Examiner* — Mohammad Ali

(74) *Attorney, Agent, or Firm* — Hamre, Schumann, Mueller & Larson, P.C.

(57) ABSTRACT

A fluid machine (201) includes: a compression mechanism (2) for compressing a working fluid; an expansion mechanism (4) for expanding the working fluid and for recovering mechanical power from the expanding working fluid; a shaft (5) for coupling the compression mechanism (2) and the expansion mechanism (4) and for transferring the mechanical power recovered by the expansion mechanism (4) to the compression mechanism (2); and a closed casing (1) for accommodating the compression mechanism (2), the shaft (5) and the expansion mechanism (4), and having an internal space into which the working fluid that has been compressed by the compression mechanism (2) is discharged. A refrigerant passage space (7) through which a refrigerant to be drawn into the expansion mechanism (4) passes is formed between an expansion chamber of the expansion mechanism (4) and the internal space of the closed casing (1).

13 Claims, 11 Drawing Sheets

FLUID MACHINE AND REFRIGERATION CYCLE APPARATUS

TECHNICAL FIELD

The present invention relates to a refrigeration cycle apparatus to be applied to a refrigerating air conditioner, a water heater, and the like, and further relates to a fluid machine that can be used suitably for a refrigeration cycle apparatus.

BACKGROUND ART

As a fluid machine constituting a refrigeration cycle apparatus, a fluid machine 419, as shown in FIG. 7, in which a compression mechanism 402 for compressing a refrigerant and an expansion mechanism 404 for converting expansion energy of a refrigerant with its decompression and expansion into mechanical power are integrated as a single unit, has been known (JP 62(1987)-77562 A). By supplying the mechanical power obtained by the expansion mechanism 404 to the compression mechanism 402 by a shaft 405, the efficiency of the refrigeration cycle apparatus is enhanced.

Since the compression mechanism 402 compresses the refrigerant adiabatically, the temperature of the components of the compression mechanism 402 rises as the temperature of the refrigerant rises. On the other hand, since the expansion mechanism 404 draws the refrigerant which has been cooled by a radiator and expands the drawn refrigerant adiabatically, the temperature of the components of the expansion mechanism 404 falls as the temperature of the refrigerant falls. Accordingly, in the case where the compression mechanism 402 and the expansion mechanism 404 are integrated simply as shown in FIG. 7, the heat of the compression mechanism 402 transfers to the expansion mechanism 404, and thereby the expansion mechanism 404 is heated and the compression mechanism 402 is cooled. In this case, as shown by arrows in a Mollier diagram of FIG. 8A, the enthalpy of the refrigerant discharged from the compression mechanism 402 decreases and the heating capacity of the radiator is reduced in a real cycle, compared with that in a theoretical cycle. Furthermore, the enthalpy of the refrigerant discharged from the expansion mechanism 404 increases and the refrigerating capacity of the evaporator is reduced.

Especially in the case of a water heater, water needs to be heated by the radiator to a preset temperature of stored hot water. Therefore, it must be ensured that the temperature of the refrigerant discharged from the compression mechanism is higher than the preset temperature of the stored hot water. However, when a thermal short-circuit occurs between the compression mechanism and the expansion mechanism, the temperature of the refrigerant discharged from the compression mechanism drops, which causes insufficient heating of water and thus reduces the temperature of the stored hot water to a temperature lower than the preset one. One of the methods for compensating the drop in the temperature of the refrigerant discharged from the compression mechanism caused by this thermal short-circuit is a method for raising the pressure of the refrigerant discharged from the compression mechanism, as in the theoretical cycle of discharge temperature control shown in FIG. 8B. Specifically, the temperature of the discharged refrigerant is raised by compressing the refrigerant somewhat excessively. By doing so, the reduction in the heating capacity caused by the thermal short-circuit can be compensated, as in the real cycle of discharge temperature control shown in FIG. 8B. This method, however, imposes an excessive workload on the compression mechanism. Therefore, the power consumption of the motor increases, which reduces the effect of recovering mechanical power in the expansion mechanism.

One of the means for solving this problem is a configuration, as shown in FIG. 9, in which the internal space of a closed casing 501 is filled with a low-pressure refrigerant guided from an evaporator into a compression mechanism 502, and the compression mechanism 502 and an expansion mechanism 504 are spaced apart from each other (JP 2005-264829 A).

Another means for solving this problem is a configuration, as shown in FIG. 10, in which the internal space of a closed casing 601 is partitioned into a low-pressure space 652 and a high-pressure space 651, an expansion mechanism 602 is disposed in the low-pressure space 652 and a compression mechanism 604 is disposed in the high-pressure space 651, and a refrigerant to be drawn into the compression mechanism 604 is guided into the low-pressure space 652 and a refrigerant discharged from the compression mechanism 604 is guided into the high-pressure space 651 (JP 2006-105564 A).

With the configuration shown in FIG. 9, the surrounding space of the expansion mechanism 504 is filled with the refrigerant to be drawn into the compression mechanism 502. Therefore, heat transfer from the refrigerant in the closed casing 501 to the expansion mechanism 504 can be suppressed. Heat transfer also occurs between the compression mechanism 502 and the refrigerant to be drawn thereinto. However, the refrigerant that has received heat from the compression mechanism 502 is compressed by the compression mechanism 502 and thereby heats the compression mechanism 502 itself. Thus, the temperature of the refrigerant discharged from the compression mechanism 502 does not drop.

However, in the configuration in which the internal space of the closed casing 501 is filled with the low-pressure refrigerant, the refrigerant discharged from the compression mechanism 502 is discharged directly to the refrigeration cycle (refrigerant circuit) through a discharge pipe 509. Therefore, the amount of oil discharged to the refrigeration cycle increases, compared to the configuration in which the internal space of the closed casing 501 is filled with the refrigerant discharged from the compression mechanism 502. The discharged oil adheres to a refrigerant pipe and increases pressure loss, or degrades the performance of the radiator and the evaporator.

On the other hand, with the configuration shown in FIG. 10, the refrigerant discharged from the compression mechanism 604 is released once into the high-pressure space 651 of the closed casing 601 and thereafter discharged to the radiator through a discharge pipe 609 of the high-pressure space 651. Since the oil is separated from the refrigerant discharged from the compression mechanism 604 in the internal space of the closed casing 601, the refrigerant discharged from the compression mechanism 604 can be prevented from circulating through the refrigeration cycle, together with a large amount of oil.

The fluid machine shown in FIG. 10, however, has a configuration in which the internal space of the closed casing 601 is partitioned into the low-pressure space 652 and the high-pressure space 651, and therefore the shaft 605 for coupling the expansion mechanism 602 and the compression mechanism 604 needs to penetrate a partitioning member 650. In this case, a mechanical seal must be used to prevent the leakage of the refrigerant from a clearance between the shaft 605 and the partitioning member 650, which causes a concern about an increase in friction loss.

DISCLOSURE OF INVENTION

It is an object of the present invention to provide a fluid machine capable of reducing an amount of oil discharged to (an amount of oil circulating through) a cycle and of suppressing heat transfer from a compression mechanism to an expansion mechanism without increasing mechanical loss.

Accordingly, the present invention provides a fluid machine including: a compression mechanism for compressing a working fluid; an expansion mechanism for expanding the working fluid and for recovering mechanical power from the expanding working fluid; a shaft for coupling the compression mechanism and the expansion mechanism and for transferring the mechanical power recovered by the expansion mechanism to the compression mechanism; and a closed casing for accommodating the compression mechanism, the shaft and the expansion mechanism, and having an internal space into which the working fluid that has been compressed by the compression mechanism is discharged. In this fluid machine, the expansion mechanism is a rotary expansion mechanism including: a roller mounted on the shaft; a cylinder in which the roller is disposed; and a suction pipe for guiding the working fluid to be expanded to the expansion mechanism. The cylinder is provided with a through-hole extending in an axis direction of the shaft between an expansion chamber in the cylinder and an outer circumferential surface of the cylinder, and the through-hole has a larger flow passage area than that of the suction pipe. The suction pipe, the through-hole, and a suction port opening to the expansion chamber are arranged in this order along a flow direction of the working fluid so that the working fluid that has flowed into the through-hole through the suction pipe flows from a first side to a second side of the axis direction and thereafter is drawn into the expansion chamber through the suction port.

In another aspect, the present invention provides a fluid machine including: a compression mechanism for compressing a working fluid; an expansion mechanism for expanding the working fluid and for recovering mechanical power from the expanding working fluid; a shaft for coupling the compression mechanism and the expansion mechanism and for transferring the mechanical power recovered by the expansion mechanism to the compression mechanism; and a closed casing for accommodating the compression mechanism, the shaft and the expansion mechanism, and having an internal space into which the working fluid that has been compressed by the compression mechanism is discharged. In this fluid machine, the expansion mechanism is a rotary expansion mechanism including: a roller mounted on the shaft; a cylinder in which the roller is disposed; and a suction pipe for guiding the working fluid to an expansion chamber formed between the roller and the cylinder. The cylinder is provided with a plurality of through-holes extending in an axis direction of the shaft between the expansion chamber and an outer circumferential surface of the cylinder. The expansion mechanism further includes: a branching passage for communicating the suction pipe and the through-holes, and formed on a first side of the axis direction so that the working fluid is guided from the suction pipe to each of the through-holes; and a merging passage for communicating the through-holes and a suction port opening to the expansion chamber, and formed on a second side of the axis direction so that the working fluid is merged after flowing through each of the through-holes and drawn from the suction port into the expansion chamber.

In still another aspect, the present invention provides a fluid machine including: a compression mechanism for compressing a working fluid; an expansion mechanism for expanding the working fluid and for recovering mechanical power from the expanding working fluid; a shaft for coupling the compression mechanism and the expansion mechanism and for transferring the mechanical power recovered by the expansion mechanism to the compression mechanism; a closed casing for accommodating the compression mechanism, the shaft and the expansion mechanism, and having an internal space into which the working fluid that has been compressed by the compression mechanism is discharged; and a jacket disposed around the expansion mechanism. The jacket forms, around the expansion mechanism, a space through which the working fluid to be drawn into the expansion mechanism passes.

In the above-mentioned fluid machine of the first aspect of the present invention, the working fluid that has been guided to the through-hole of the cylinder through the suction pipe flows through the through-hole from the first side to the second side of the axis direction and thereafter is drawn into the expansion chamber through the suction port. The through-hole is provided between the expansion chamber and the outer circumferential surface of the cylinder. The thermal resistance of the cylinder is increased by providing the through-hole around the expansion chamber, compared with the case without providing any through-hole. Therefore, the heat transfer from the surrounding space of the cylinder to the expansion chamber is suppressed. In other words, the heat transfer from the compression mechanism to the expansion mechanism is suppressed.

The high-temperature and high-pressure working fluid is discharged into the internal space of the closed casing, and thus the surrounding space of the expansion mechanism also is in a high-pressure atmosphere. Therefore, if the through-hole is a simple hollow cavity, a concern about the withstanding pressure of the cylinder might arise. In contrast, in the present invention, the low-temperature and high-pressure working fluid to be expanded flows through the through-hole. Therefore, the present invention has no such problem of the cylinder being deformed by the external pressure. In addition, since the flow passage area of the through-hole is larger than that of the suction pipe, the flow speed of the working fluid is reduced in the through-hole. As a result, the heat transfer coefficient on a working fluid side part where the through-hole is provided decreases, and thus the effect of suppressing the heat transfer is enhanced further.

Furthermore, the working fluid to be expanded receives heat in the process of flowing through the through-hole and raises its temperature. Therefore, the mechanical power to be recovered theoretically in the expansion process increases, which increases the absolute value of the recoverable mechanical power by the expansion mechanism. In other words, when the fluid machine of the present invention is used for a refrigeration cycle apparatus, the performance of the refrigeration cycle can be enhanced.

Furthermore, the fluid machine of the present invention is a so-called a high-pressure shell type fluid machine in which a compressed working fluid is discharged into the internal space of a closed casing. Accordingly, oil mixed in the working fluid compressed by the compression mechanism can be separated sufficiently from the working fluid in the internal space of the closed casing.

Furthermore, according to the present invention, there is no need to partition the internal space of the closed casing into a high-pressure space and a low-pressure space. Therefore, there is no need to provide, around the shaft, a special structure such as a mechanical seal for preventing the leakage of a refrigerant, as shown in the conventional example in which the internal space of the closed casing is partitioned into a high-pressure space and a low-pressure space (see FIG. 10). Thus, neither does the problem of an increase in mechanical loss occur.

According to the fluid machine of the second aspect of the present invention, the cylinder is provided with a plurality of through-holes. The working fluid that has been guided from the suction pipe to the through-holes by way of the branching passage is merged in the merging passage after flowing through the through-holes from the first side to the second side and drawn into the expansion chamber. The thermal resistance of the cylinder is increased by providing the plurality of through-holes around the expansion chamber, compared with the case without providing any through-hole. Therefore, the heat transfer from the surrounding space of the cylinder to the expansion chamber is suppressed. In this case, there is no limitation on the size relationship between the flow passage area of the suction pipe and that of the through-holes.

According to the fluid machine of the third aspect of the present invention, the jacket disposed around the expansion mechanism forms, around the expansion mechanism, a space through which a working fluid to be drawn into the expansion mechanism passes. The thermal resistance of this space through which the working fluid to be expanded passes is higher than that of the components of the expansion mechanism. Accordingly, the effect of suppressing the heat transfer from the surrounding space of the expansion mechanism to the expansion chamber, that is, the effect of suppressing the heat transfer from the compression mechanism to the expansion mechanism is obtained.

BEST MODE FOR CARRYING OUT THE INVENTION

Hereinafter, embodiments of the present invention will be described with reference to the accompanying drawings.

First Embodiment

Figure 1:
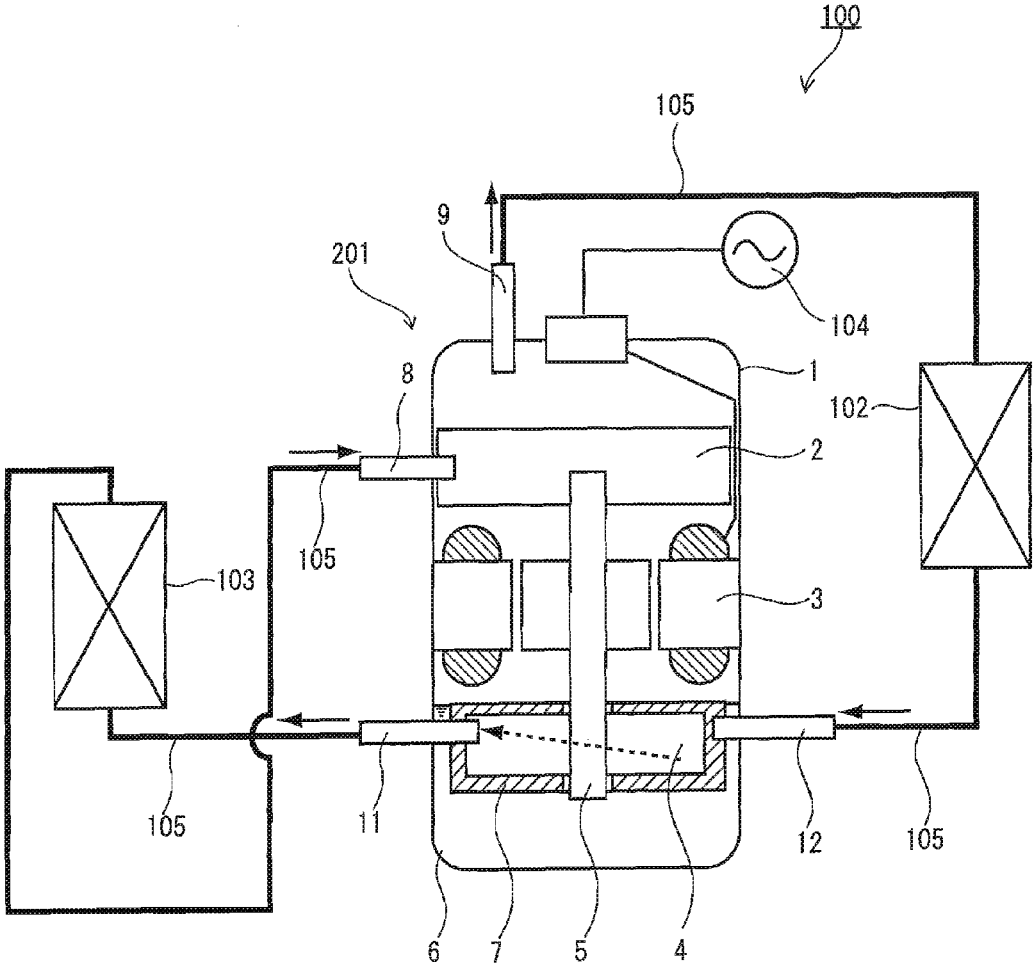
FIG. 1 is a configuration diagram illustrating a refrigeration cycle apparatus according to the present invention.
Figure 2:
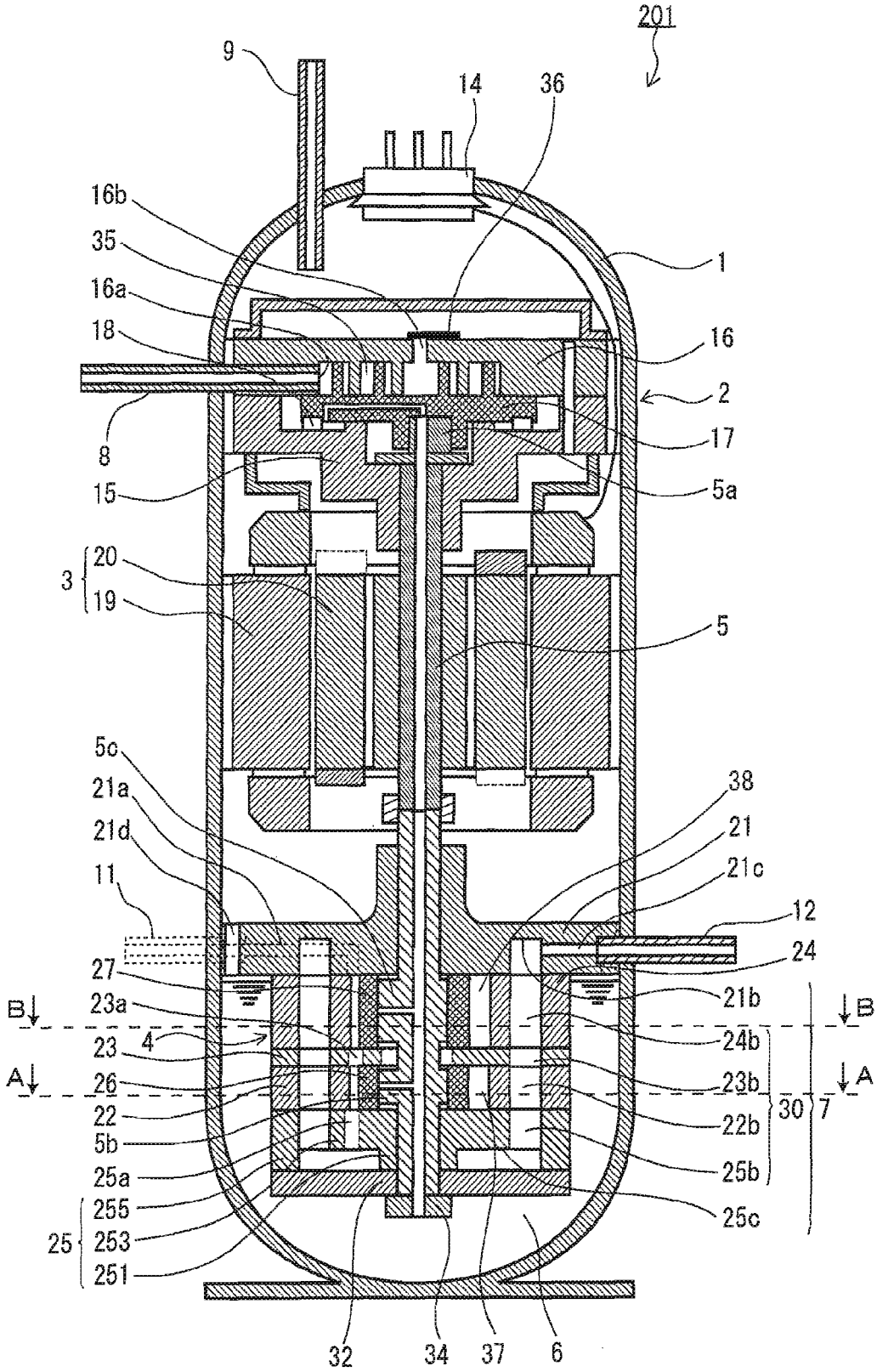
FIG. 2 is a vertical sectional view of a fluid machine according to a first embodiment of the present invention.
Figure 3A:
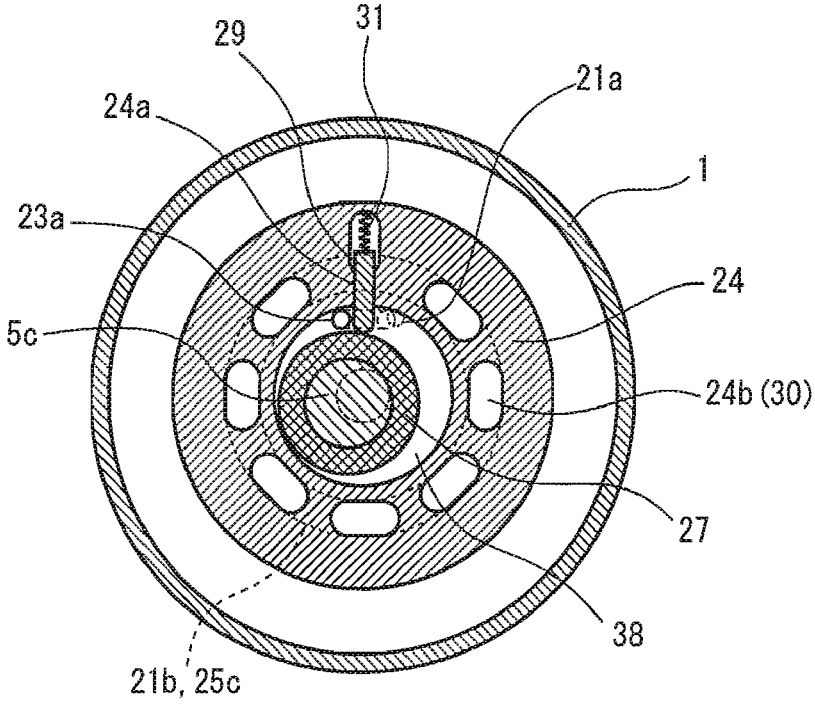
FIG. 3A is a cross-sectional view of the fluid machine taken along the line B-B of FIG. 2.
Figure 3B:
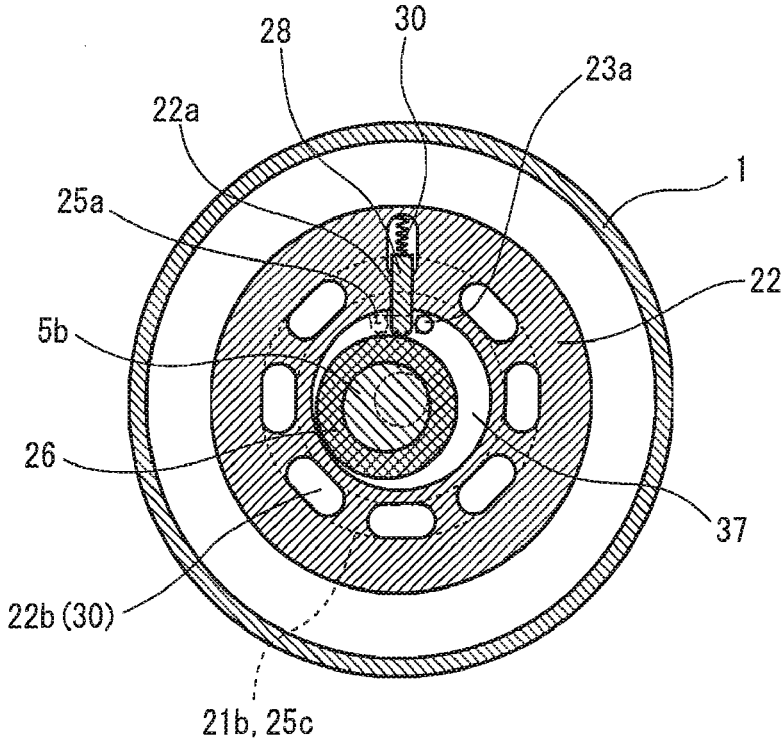
FIG. 3B is a cross-sectional view of the fluid machine taken along the line A-A of FIG. 2.

FIG. 1 is a configuration diagram illustrating a refrigeration cycle apparatus according to an embodiment of the present invention. FIG. 2 is a vertical sectional view of a fluid machine applied to the refrigeration cycle apparatus shown in FIG. 1. FIG. 3A is a cross-sectional view of the fluid machine taken along the line B-B of FIG. 2. FIG. 3B is a cross-sectional view thereof taken along the line A-A of FIG. 2.

As shown in FIG. 1, a refrigeration cycle apparatus 100 includes a fluid machine 201 (expander-integrated compressor), a radiator 102, an evaporator 103, and a plurality of refrigerant pipes for connecting the fluid machine 201, the radiator 102, and the evaporator 103 so as to form a main refrigerant circuit through which a refrigerant circulates. The refrigerant as a working fluid is, for example, carbon dioxide or hydrofluorocarbon.

The fluid machine 201 includes a compression mechanism 2 for compressing the refrigerant, a motor 3, an expansion mechanism 4 for expanding the refrigerant, a shaft 5, and a closed casing 1 for accommodating these components. The compression mechanism 2, the motor 3, and the expansion mechanism 4 are coupled by the shaft 5, and arranged in this order from the top down in the internal space of the closed casing 1. The expansion mechanism 4 recovers mechanical power from the refrigerant. The mechanical power recovered by the expansion mechanism 4 is superposed, via the shaft 5, on the mechanical power of the motor 3 for driving the compression mechanism 2. The bottom part of the closed casing 1 is used as an oil reservoir 6 for holding oil for lubrication of respective sliding parts of the compression mechanism 2 and the expansion mechanism 4.

The fluid machine 201 further includes a refrigerant passage space 7 through which the refrigerant to be drawn into the expansion mechanism 4 passes. The refrigerant passage space 7 is a space separated from the internal space of the closed casing 1, and is formed between the expansion chamber of the expansion mechanism 4 and the internal space of the closed casing 1. The thermal resistance of the refrigerant passage space 7 through which the refrigerant to be drawn into the expansion mechanism 4 passes is higher than that of the components (for example, the cylinder) of the expansion mechanism 4. Therefore, the refrigerant passage space 7 exerts the effect of suppressing heat transfer from the refrigerant discharged from the compression mechanism 2 and the oil held in the oil reservoir 6 to the expansion chamber of the expansion mechanism 4. The amount of heat lost from the refrigerant discharged from the compression mechanism 2 and the oil held in the oil reservoir 6 can be reduced relatively. In other words, the presence of the refrigerant passage space 7 suppresses the heat transfer from the compression mechanism 2 to the expansion mechanism 4.

The configuration of the fluid machine 201 will be described in detail. The closed casing 1 keeps the surrounding space of the compression mechanism 2 and the expansion mechanism 4 at a pressure equal to that of the refrigerant discharged from the compression mechanism 2. Specifically, the fluid machine 201 is a so-called a high-pressure shell type fluid machine. The refrigerant that has been compressed by the compression mechanism 2 is once discharged into the internal space of the closed casing 1, and thereafter discharged from the closed casing 1 to the radiator 102 through the discharge pipe 9. In the closed casing 1, the oil can be separated sufficiently from the refrigerant discharged from the compression mechanism 2. Accordingly, a problem, such that the oil adheres to the refrigerant pipe 105, which causes an increase in the pressure loss and a degradation in the heat transfer performance of the radiator 102 and the evaporator 103, is less likely to occur.

As shown in FIG. 2, the oil held in the oil reservoir 6 is drawn into an oil pump 34 disposed at the lower end of the shaft 5, and supplied to the respective sliding parts of the compression mechanism 2 and the expansion mechanism 4 by way of an oil supply passage in the shaft 5. Since the oil has a higher density than that of the refrigerant, it settles down in the closed casing 1 by gravitational force and returns again to the oil reservoir 6 through a cut-out 21*d* of an upper bearing 21 of the expansion mechanism 4. Oil discharged together with the refrigerant from the compression mechanism 2 also is separated from the refrigerant in the closed casing 1 and returns to the oil reservoir 6.

The compression mechanism 2 is a so-called scroll type mechanism including a main bearing 15, a stationary scroll 16, an orbiting scroll 17, and a rotation restraining mechanism 18 such as an Oldham ring. The main bearing 15 for supporting the shaft 5 is fixed to the inner wall of the closed casing 1 by welding, shrink fitting, or the like. The stationary scroll 16 is bolted to the upper part of the main bearing 15. The orbiting scroll 17 meshing with the stationary scroll 16 is disposed between the stationary scroll 16 and the main bearing 15. The rotation restraining mechanism 18 for preventing the orbiting scroll 17 from rotating on its axis is provided between the orbiting scroll 17 and the main bearing 15. The orbiting scroll 17 is driven eccentrically by a main shaft portion 5*a* provided at the upper end of the shaft 5 and thereby moves in a circular orbit.

A terminal 14 for supplying electric power from a commercial power source 104 to the motor 3 is disposed penetrating the top of the closed casing 1. The motor 3 includes a stator 19 fixed to the closed casing 1 and a rotor 20 fixed to the shaft 5, and is disposed between the compression mechanism 2 and the expansion mechanism 4.

The expansion mechanism 4 is a two-stage rotary expansion mechanism including: rollers (pistons) 26, 27 mounted on the shaft 5; cylinders 22, 24 in which the rollers 26, 27 are disposed; vanes 28, 29 for partitioning expansion chambers 37, 38 formed between the rollers 26, 27 and the cylinders 22, 24 into suction-side spaces and discharge-side spaces, respectively (see FIG. 3A and FIG. 3B); springs 30, 31 disposed in vane grooves formed in the cylinders 22, 24; a suction pipe 12 for guiding a refrigerant to be expanded to the expansion mechanism 4; a discharge pipe 11 for discharging the expanded refrigerant from the expansion mechanism 4 outside the closed casing 1; bearings 21, 25; and a closing plate 32. The space surrounding the expansion mechanism 4 is filled with the oil held in the oil reservoir 6.

The shaft 5 is supported rotatably by the upper bearing 21 and the lower bearing 25. The shaft 5 of the present embodiment includes a first part on the compression mechanism side and a second part on the expansion mechanism side. The first part and the second part are coupled coaxially with each other. The shaft may be composed of a single member.

The upper bearing 21 is fixed to the inner wall of the closed casing 1. A suction passage 21*c* and a discharge passage 21*a* each extending from a portion in contact with the inner wall of the closed casing 1 toward the shaft 5 are provided inside the upper bearing 21. The suction pipe 12 and the discharge pipe 11 are connected directly to the upper bearing 21 so that the refrigerant to be expanded is guided from the suction pipe 12 to the suction passage 21*c* and the expanded refrigerant is guided from the discharge passage 21*a* to the discharge pipe 11. The second cylinder 24 is fixed to the lower part of the upper bearing 21. One end of the discharge passage 21*a* in the upper bearing 21 faces the expansion chamber 38 of the second cylinder 24. An intermediate plate 23 is fixed to the lower part of the second cylinder 24, and the first cylinder 22 is fixed to the lower part of the intermediate plate 23. Furthermore, the lower bearing 25 is fixed to the lower part of the first cylinder 22. The lower bearing 25 has a suction port 25*a* serving as a suction passage for drawing the refrigerant into the expansion chamber 37 of the first cylinder 22. Furthermore, a closing plate 32 is fixed to the lower bearing 25 in such a manner that the lower part of the lower bearing 25 is covered with the closing plate 32.

As shown in FIG. 3B, the first roller 26 is disposed in the first cylinder 22 and is fitted rotatably to a first eccentric portion 5*b* of the shaft 5. As shown in FIG. 3A, the second roller 27 is disposed in the second cylinder 24 and is fitted rotatably to a second eccentric portion 5*c* of the shaft 5. The first vane 28 is disposed slidably in a first vane groove 22*a* formed in the first cylinder 22. The second vane 29 is disposed slidably in a second vane groove 24*a* formed in the second cylinder 24. One end of the first spring 30 is in contact with the first cylinder 22 and the other end thereof is in contact with the first vane 28, and thereby the first spring 30 presses the first vane 28 against the first roller 26. One end of the second spring 31 is in contact with the second cylinder 24 and the other end thereof is in contact with the second vane 29, and thereby the second spring 31 presses the second vane 29 against the second roller 27. The expansion chambers 37, 38 formed between the cylinders 22, 24 and the rollers 26, 27 are each partitioned into two chambers by the vanes 28, 29.

In the present embodiment, a so-called rolling piston type rotary mechanism is employed, in which the leading ends of the vanes 28, 29 are in slidable contact with the rollers 26, 27. However, a so-called swinging piston type rotary mechanism, in which a roller and a vane are integrated as a single unit, also can be employed suitably in the present invention.

In the present embodiment, the refrigerant passage space 7 described in FIG. 1 is included in the expansion mechanism 4. Specifically, as shown in FIG. 2, the refrigerant passage space 7 is constituted of a recessed portion 21*b* formed in the upper bearing 21, a through-hole 30, and a recessed portion 25*c* formed in the lower bearing 25. The through-hole 30 is constituted of a through-hole 24*b* formed in the second cylinder 24, a through-hole 23*b* formed in the intermediate plate 23, a through-hole 22*b* formed in the first cylinder 22, and a through-hole 25*b* formed in the lower bearing 25, which are connected in series in this order along the axis direction of the shaft 5. In other words, the through-hole 30 penetrates vertically the second cylinder 24, the intermediate plate 23, the first cylinder 22 and the lower bearing 25, and is communicated with the recessed portion 21*b* of the upper bearing 21 on the first side (upper side) of the axis direction and communicated with the recessed portion 25*c* of the lower bearing 25 on the second side (lower side) thereof.

The suction pipe 12, the through-hole 30 and the suction port 25*a* are arranged in this order along a flow direction of the refrigerant so that the refrigerant that has flowed into the through-hole 30 through the suction pipe 12 flows from the first side to the second side of the axis direction and thereafter is drawn into the expansion chambers 37, 38 through the suction port 25*a*. In the present embodiment, the first side and the second side of the axis direction are the upper side and the lower side, respectively. However, the first side may be the lower side, and the second side may be the upper side.

The thermal resistance of the cylinders 22, 24 is increased by providing the through-hole 30 around the expansion chambers 37, 38, which produces the effect of suppressing the heat transfer from the surrounding space of the cylinders 22, 24 to the expansion chambers 37, 38. Furthermore, the through-hole 30 has a larger flow passage area than that of the suction pipe 12, and than the opening area of the suction port 25*a* opening to the expansion chambers 37, 38. Accordingly, the flow speed of the refrigerant that has been guided to the through-hole 30 through the suction pipe 12 is lower than that in the suction pipe 12. As a result, the heat transfer coefficient on a refrigerant side part where the through-hole 30 is provided decreases, and thus the effect of suppressing the heat transfer is exerted sufficiently. It should be noted that the flow passage area of the through-hole 30 means a cross-sectional area in a direction orthogonal to the axis direction, and the flow passage area of the suction pipe 12 means a cross-sectional area in a direction orthogonal to the longitudinal direction thereof.

It is preferable, as shown in FIG. 3A and FIG. 3B, that a plurality of through-holes 30 are provided in the cylinders 22, 24 so that the through-holes 30 have a larger flow passage area in total than that of the suction pipe 12 and than the opening area of the suction port 25*a*. More specifically, the through-holes 30 are arranged between the outer circumferential surfaces of the cylinders 22, 24 and the expansion chambers 37, 38 at approximately equal angles around the expansion chambers 37, 38. With such a configuration, it is possible to obtain the effect of suppressing the heat transfer from the oil in the surrounding space of the expansion mechanism 4 to the refrigerant in the expansion chambers 37, 38 while maintaining adequate strength for the cylinders 22, 24. These through-holes 30 may be formed by a molding process for manufacturing the cylinders 22, 24, or may be formed by machining such as cutting, grinding, and polishing.

Figure 4:
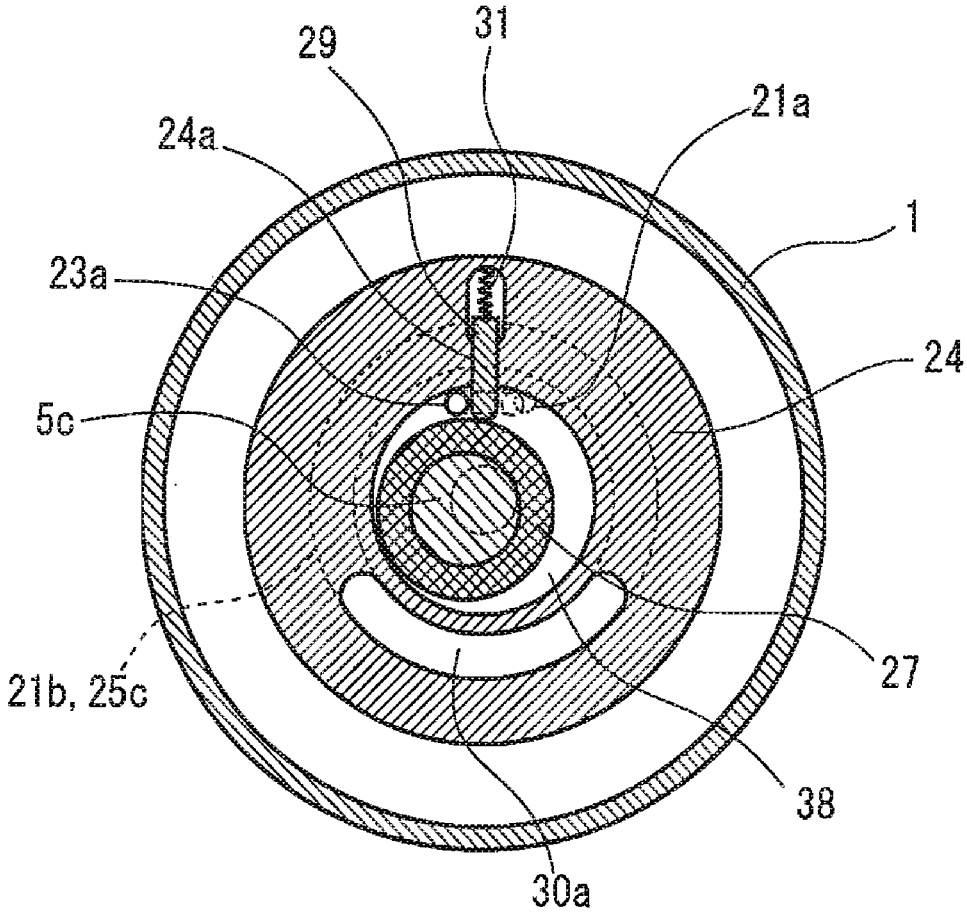
FIG. 4 is a cross-sectional view of a through-hole according to another embodiment.

As shown in FIG. 4, a single arc-shaped through-hole 30*a*, for example, may be formed in the cylinders 22, 24.

As shown in FIG. 2, a part of the upper bearing 21 is in contact with the second cylinder 24, and the recessed portion 21*b* is formed in the part. The suction pipe 12 is connected to this recessed portion 21*b* via the suction passage 21*c*. Thus, the recessed portion 21*b* of the upper bearing 21 serves as a branching passage for communicating the suction pipe 12 and the through-holes 30 and formed on the first side (upper side in FIG. 2) of the axis direction so that the refrigerant is guided from the suction pipe 12 to each of the through-holes 30. In other words, the expansion mechanism 4 has such a branching passage. The recessed portion 21*b* serves as a branching passage, and thereby the refrigerant to be drawn into the expansion mechanism 4 can be delivered to all the through-holes 30.

As described above, the expansion mechanism 4 includes the upper bearing 21 serving as a first closing member for closing the second cylinder 24 on the first side. In this expansion mechanism 4, the recessed portion 21*b* serving as a branching passage is formed in the upper bearing 21, and the suction pipe 12 is connected to the upper bearing 21 so that the refrigerant can be supplied to the recessed portion 21*b*. Accordingly, there is no increase in component count compared with conventional rotary expansion mechanisms, and thus there is no possibility of an increase in production cost.

A part of the upper bearing 21 is in contact with the second cylinder 24, the branching passage is constituted of the recessed portion 21*b* formed in the part, and each of the through-holes 30 faces the recessed portion 21*b* of the upper bearing 21. Thereby, the refrigerant to be drawn into the expansion mechanism 4 can be delivered to all the through-holes 30. It should be noted that there is no limitation on the shape and the dimensions of the recessed portion 21*b* of the upper bearing 21 as long as the refrigerant can be fed to all the through-holes 30. In the present embodiment, the recessed portion 21*b* of the upper bearing 21 has a ring shape in accordance with the arrangement of the through-holes 30.

On the other hand, the lower bearing 25 includes: a center portion 251 for supporting the shaft 5; a bank-shaped outer circumferential portion 255 to which the closing plate 32 is fixed; and a thin portion 253 provided between the center portion 251 and the outer circumferential portion 255 and on the side opposite to the side in contact with the first cylinder 22, and having a thickness less than that of the center portion 251 and that of the outer circumferential portion 255. The suction port 25*a* opening to the expansion chamber 37 is provided in the thin portion 253. Furthermore, the lower bearing 25 is covered with the disk-shaped closing plate 32, and thereby a ring-shaped recessed portion 25*c* is formed along the shape of the thin portion 253.

The recessed portion 25*c* of the lower bearing 25 is formed on the side opposite to the side in contact with the first cylinder 22, and the recessed portion 25*c* and the expansion chamber 37 in the first cylinder 22 are connected to each other via the suction port 25*a*. Furthermore, the recessed portion 25*c* serves as a merging passage for communicating the through-holes 30 and the suction port 25*a* and formed on the second side (lower side in FIG. 2) of the axis direction so that the refrigerant is merged after flowing through each of the through-holes 30 and drawn from the suction port 25*a* into the expansion chamber 37. In other words, the expansion mechanism 4 has such a merging passage. The recessed portion 25*c* serves as a merging passage, and thereby the refrigerant that has flowed through each of the through-holes 30 can be fed smoothly to the expansion chamber 37.

Thus, the expansion mechanism 4 includes the lower bearing 25 serving as a second closing member for closing the first cylinder 22 on the second side (lower side in the axis direction). Moreover, the lower bearing 25 is provided with the recessed portion 25*c* serving as the merging passage as well as the suction port 25*a* opening to the expansion chamber 37. Accordingly, there is no increase in component count compared with conventional rotary expansion mechanisms, and thus there is no possibility of an increase in production cost. Furthermore, the recessed portion 21*b* of the upper bearing 21 and the recessed portion 25*c* of the lower bearing 25 allow the refrigerant to be drawn into the expansion mechanism 4 to flow smoothly through the through-holes 30 and thereafter to be drawn smoothly from the suction port 25*a* into the expansion chamber 37. Accordingly, during the operation of the refrigeration cycle apparatus 100, a phenomenon in which the refrigerant remains in a specific through-hole is less likely to occur.

As shown in FIG. 2, the suction port 25*a* in the thin portion 253 of the lower bearing 25 is positioned at an angle of approximately 180 degrees in the rotational direction of the shaft 5 from the position of the suction pipe 12. With such an arrangement, the refrigerant that has been guided into the upper bearing 21 through the suction pipe 12 flows around to the opposite side of the shaft 5 by 180 degrees and then flows into the suction port 25*a*. Accordingly, an equal amount of refrigerant is allowed to flow through each of the through-holes 30.

Next, the operation of the fluid machine 201 will be described below.

When electric power is supplied from the terminal 14 to the motor 3, rotational power is generated between the stator 19 and rotor 20, and thereby the shaft 5 drives the compression mechanism 2. As a result, the compression chamber 35 formed between the stationary scroll 16 and the orbiting scroll 17 reduces its volumetric capacity while moving from the outer circumferential side toward the center. This change in volumetric capacity of the compression chamber 35 is employed to draw the refrigerant from the suction pipe 8 extending to the outside of the closed casing 1 and the suction port 16*a* provided on the outer circumferential portion of the stationary scroll 16, and thus the drawn refrigerant is compressed. When the refrigerant is compressed to a predetermined pressure, it presses and opens a lead valve 36 and is discharged into the internal space of the closed casing 1 through the discharge port 16*b* provided in the center of the stationary scroll 16.

The high-pressure refrigerant discharged into the internal space of the closed casing 1 passes through the discharge pipe 9 and travels toward the radiator 102 (see FIG. 1) outside the closed casing 1 while absorbing the heat of the motor 3. The refrigerant is cooled by the radiator 102 and then is drawn into the expansion mechanism 4 through the suction pipe 12. The refrigerant flows through the refrigerant passage space 7 from top down along the axis direction, and is drawn from the suction port 25*a* into the expansion chamber 37 of the first cylinder 22.

As shown in FIG. 3B, the first expansion chamber 37 is formed in the expansion mechanism 4. The first expansion chamber 37 is a space surrounded by the lower bearing 25, the first cylinder 22, the first roller 26 and the intermediate plate 23. The first expansion chamber 37 is partitioned into two chambers, a suction-side space and a discharge-side space, by the first vane 28. As shown in FIG. 3A, the second expansion chamber 38 is formed on the opposite side of the first expansion chamber 37 across the intermediate plate 23. The second expansion chamber 38 is a space surrounded by the intermediate plate 23, the second cylinder 24, the second roller 27 and the upper bearing 21. The second expansion chamber 38 also is partitioned into two chambers, a suction-side space and a discharge-side space, by the second vane 29. The discharge-side space of the first expansion chamber 37 and the suction-side space of the second expansion chamber 38 are communicated with each other to form one space through a communication hole 23*a* formed in the intermediate plate 23. The communication hole 23*a* is positioned on the opposite side of the suction port 25*a* across the first vane 28 when seen from the side of the first expansion chamber 37, while it is positioned on the opposite side of the discharge passage 21*a* across the second vane 29 when seen from the side of the second expansion chamber 38.

When the high-pressure refrigerant that has flowed in the refrigerant passage space 7 flows into the suction port 25*a*, the first roller is pressed to rotate the shaft 5, and the volumetric capacity of the suction-side space of the first expansion chamber 37 to which the suction port 25*a* opens increases. When the refrigerant is drawn by the eccentric rotational motion of the first roller 26 until the volumetric capacity of the suction-side space of the first expansion chamber 37 reaches a predetermined level, the communication between the suction-side space of the first expansion chamber 37 and the suction port 25*a* is broken. The discharge-side space of the first expansion chamber 37, in turn, is communicated with the communication hole 23*a*. As a result, the discharge-side space of the first expansion chamber 37 and the suction-side space of the second expansion chamber 38 are communicated with each other to form one space through the communication hole 23*a*. As the shaft 5 rotates further, the volumetric capacity of the discharge-side space of the first expansion chamber 37 decreases. At the same time, the suction-side space of the second expansion chamber 38 having a larger cylinder capacity begins to increase its volumetric capacity, and the refrigerant travels from the first expansion chamber 37 to the second expansion chamber 38 while expanding.

When the second roller 27 continues the eccentric rotational motion as the shaft 5 rotates further, the pressure of the refrigerant in the second expansion chamber 38 drops to the pressure of the refrigerant flowing in the evaporator 103 (i.e., the low pressure of the refrigeration cycle). As the shaft 5 rotates further subsequently, the volumetric capacity of the second expansion chamber 38 decreases, and the refrigerant passes through the discharge passage 21*a* and is discharged through the discharge pipe 11 toward the evaporator 103. The refrigerant that has expanded adiabatically in the expansion mechanism 4 and provided work for the shaft 5 is heated by the evaporator 103 and returns to the suction pipe 8 of the compression mechanism 2.

During the above-mentioned operation process, the refrigerant flowing from the radiator 102 toward the expansion mechanism 4 (refrigerant to be drawn into the expansion mechanism 4) passes through the refrigerant passage space 7 and thereafter is drawn into the expansion chamber 37. The refrigerant to be drawn into the expansion mechanism 4 receives heat from the refrigerant and the oil in the internal space of the closed casing 1 during its flowing through the refrigerant passage space 7 constituted of the recessed portions 21*b*, 25*b* and the through-holes 30. The thermal resistance of the cylinders 22, 24 is increased by providing the through-holes 30 around the expansion chambers 37, 38, which suppresses the heat transfer from the surrounding space of the cylinders 22, 24 to the expansion chambers 37, 38, compared with the case without such through-holes 30. Furthermore, the thermal resistance of the bearings 21, 25 also is increased by providing the recessed portions 21*b*, 25*c*.

Next, other features of the fluid machine 201 according to the present embodiment will be described. According to the present embodiment, the refrigerant passage space 7 is isolated from the internal space of the closed casing 1 and thus the shaft 5 does not face (is not exposed to) the refrigerant passage space 7. The problem that the refrigerant flowing through the refrigerant passage space 7 leaks from around the shaft 5 is essentially nonexistent. Therefore, there is no need to provide a sealing structure such as a mechanical seal around the shaft 5, and thus a problem that such a sealing structure increases mechanical loss does not occur.

The compression mechanism 2, the motor 3 and the expansion mechanism 4 are arranged from top down in this order in the internal space of the closed casing 1 so that the surrounding space of the expansion mechanism 4 is filled with the oil held in the oil reservoir 6. The oil level is located between the upper end surface and the lower end surface of the second cylinder 24. Since the viscosity of the oil is higher than that of the refrigerant, the convection of the oil held in the oil reservoir 6 is not so strong as that of the refrigerant filled in the surrounding space of the compression mechanism 2 and the motor 3. Furthermore, the sealing effect of the oil reduces the amount of high-pressure refrigerant leaking into the expansion mechanism 4 through the gaps between the components. Accordingly, it is possible to reduce further the heat transfer to the expansion mechanism 4.

It should be noted, however, that the position of the compression mechanism 2 and the position of the expansion mechanism 4 may be reversed. Specifically, the expansion mechanism 4 may be positioned in the upper part of the closed casing 1 and the compression mechanism 2 may be positioned in the lower part thereof. Furthermore, the shaft 5 need not necessarily be disposed in such a manner that the axis direction of the shaft 5 is parallel to the vertical direction. For example, the compression mechanism and the expansion mechanism may be arranged in such a manner that the axis direction of the shaft is parallel to the horizontal direction or parallel to the oblique direction inclined from the vertical and horizontal directions.

Furthermore, the flow passage area of the refrigerant passage space 7 is larger than that of the suction pipe 12. In other words, the total area of the cross sections of the through-holes 30 orthogonal to the axis direction is larger than the cross-sectional area of the suction pipe 12. In this case, the flow speed of the refrigerant in the refrigerant passage space 7 is lower than that of the refrigerant in the suction pipe 12, which makes it possible to supply the refrigerant stably to the expansion mechanism 4. The decrease in heat transfer coefficient due to the decrease in flow speed enhances the thermal insulation effect further. In addition, the muffler effect of the refrigerant passage space 7 also produces the effect of reducing pressure pulsation and noise caused by a water hammer phenomenon that occurs in the suction process of the expansion mechanism 4. More preferably, the flow passage area of each of the through-holes 30 is larger than the flow passage area of the suction pipe 12 and than the opening area of the suction port 25*a*. In this case, the above-mentioned effects are enhanced further.

Second Embodiment

Figure 5:
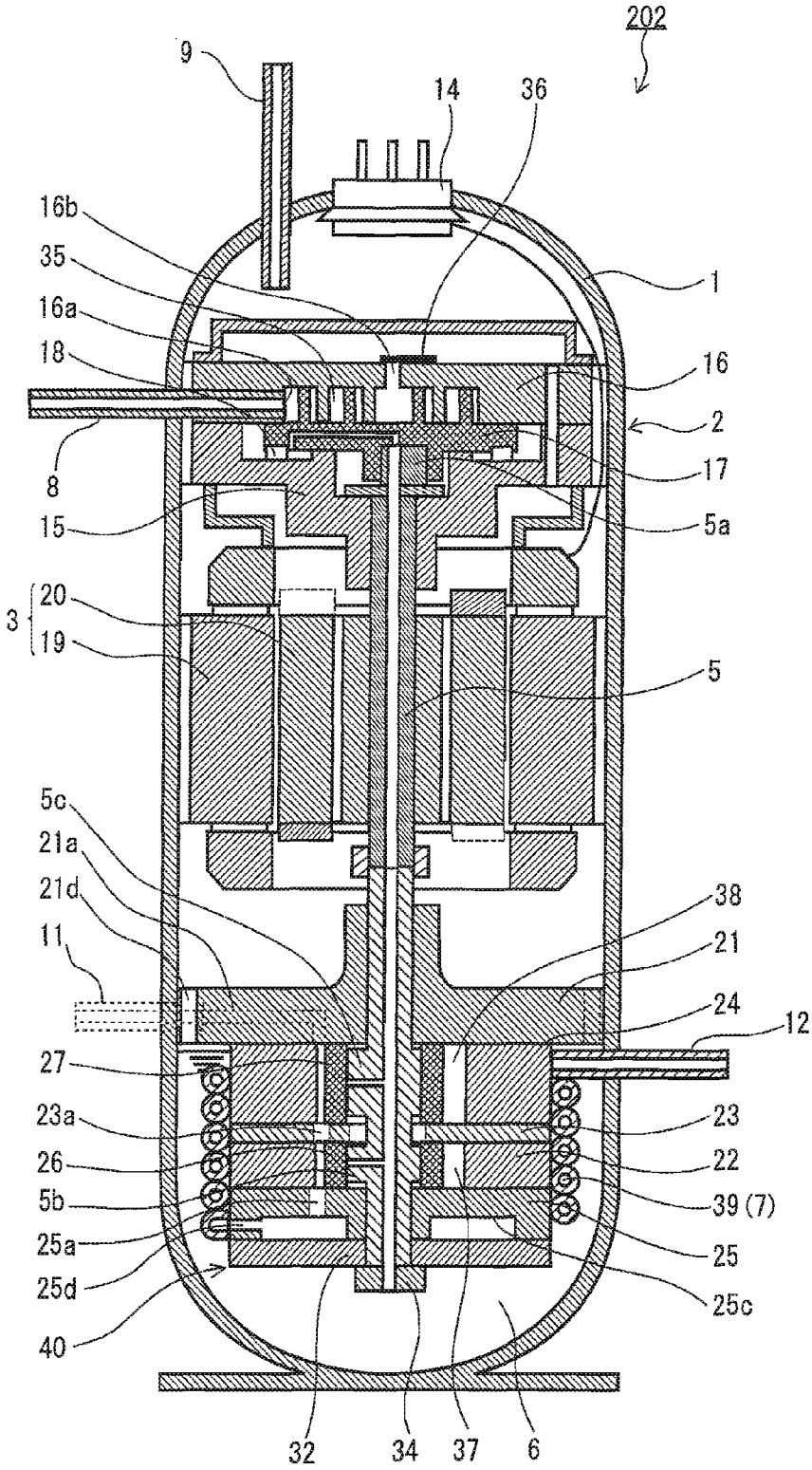
FIG. 5 is a vertical sectional view of a fluid machine according to a second embodiment of the present invention.

FIG. 5 is a vertical sectional view of another fluid machine that can be used suitably for the refrigeration cycle apparatus 100 of FIG. 1. As shown in FIG. 5, the basic configuration of a fluid machine 202 of the present embodiment is the same as that of the fluid machine described in the first embodiment.

The present embodiment differs from the above-described first embodiment in the form of the refrigerant passage space 7. In the present embodiment, the refrigerant passage space 7 through which a refrigerant to be drawn into an expansion mechanism 40 passes is formed of a jacket disposed around the expansion mechanism 40. One example of such a jacket is a pipe 39 wound around the expansion mechanism 40. The internal space of the pipe is used as the refrigerant passage space 7. According to the present embodiment, since the pipe merely is wound around the expansion mechanism 40, its cost is low. As this pipe 39, an inner grooved pipe for a heat exchanger can be used suitably.

As shown in FIG. 5, the pipe 39 is wound in spirals around the expansion mechanism 40 in such a manner that adjacent spiral portions of the pipe are in contact with each other. Furthermore, the pipe 39 also is used as the suction pipe 12 for guiding a working fluid to be expanded to the expansion mechanism 40, and one end of the pipe 39 extends outside the closed casing 1 and the other end thereof is connected to the expansion mechanism 4. Arranged in this manner, the pipe 39 does not require any joints. Thus, the pipe 39 can be wound closely around the expansion mechanism 40. Moreover, since the pipe 39 constituting the refrigerant passage space 7 also is used as the suction pipe 12, the problem of an increase in component count also is less likely to occur.

As shown in FIG. 5, the other end of the pipe 39 is connected to the lower bearing 25 as a closing member for closing the first cylinder 22. The lower bearing 25 is provided with the ring-shaped recessed portion 25*c* on the side opposite to the side in contact with the first cylinder 22. The lower bearing 25 is covered with the closing plate 32, and thereby a space is formed along the shape of the recessed portion 25*c*. The space formed along the shape of the recessed portion 25*c* is a part of the refrigerant passage space 7. In a portion of the lower bearing 25 to which the pipe 39 is connected, a suction passage 25*d* is formed so that the refrigerant can be supplied to the space formed along the shape of the recessed portion 25*c*. The refrigerant that has flowed through the pipe 39 passes through the suction passage 25*d* of the lower bearing 25 and the space formed along the shape of the recessed portion 25*c* of the lower bearing 25, and then is drawn into the expansion chamber 37 of the first cylinder 22 through the suction port 25*a*.

The refrigerant to be drawn into the expansion mechanism 40 receives heat from the refrigerant and the oil in the internal space of the closed casing 1 during its flowing through the pipe 39. The thermal resistance of the pipe 39 through which the refrigerant to be expanded flows is higher than the thermal resistance of the components (for example, the cylinders 22, 24) of the expansion mechanism 40. Accordingly, the effect of suppressing the heat transfer from the surrounding space of the expansion mechanism 40 to the expansion chambers 37, 38, that is, the effect of suppressing the heat transfer from the compression mechanism 2 to the expansion mechanism 40 is obtained.

Furthermore, the pipe 39 is wound around the second cylinder 24, the intermediate plate 23 and the first cylinder 22 of the expansion mechanism 40 in this order. Adjacent spiral portions of the pipe 39 are in contact with each other in the axis direction, and the cylinders 22, 24 and the pipe 39 are in contact with each other in the radial direction. In other words, the pipe 39 is wound closely around the cylinders 22, 24 so that the pipe 39 has as long a length as possible. With this arrangement of the pipe 39, the effect of suppressing the heat transfer from the refrigerant and the oil in the internal space of the closed casing 1 to the expansion mechanism 40 is enhanced. In the present embodiment, each spiral portion of the pipe 39 has a single turn, but it may have two or more turns. Furthermore, a shallow groove may be formed on the outer circumferential surface of the cylinder in such a manner that the pipe 39 is disposed along the groove.

Third Embodiment

Figure 6:
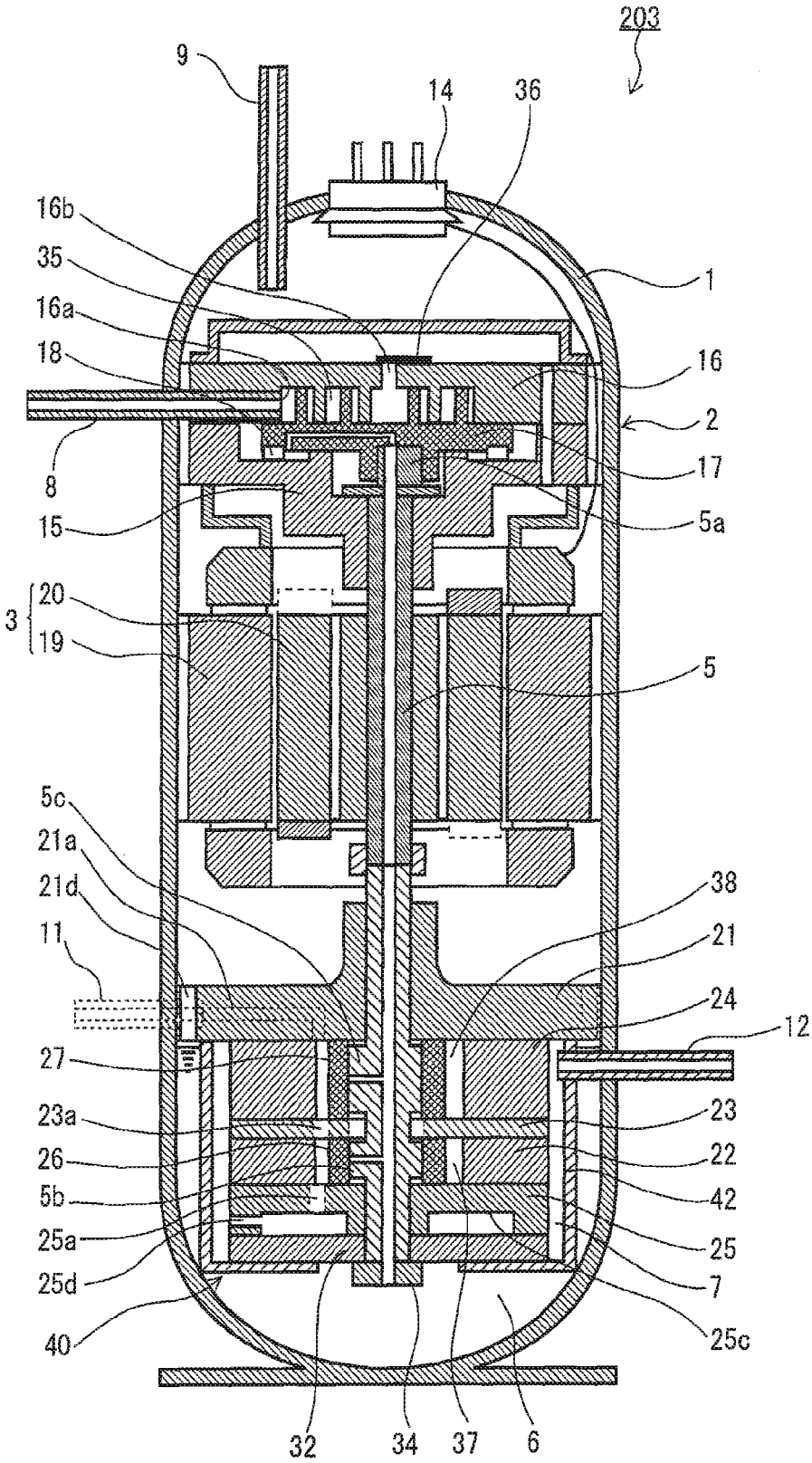
FIG. 6 is a vertical sectional view of a fluid machine according to a third embodiment of the present invention.
Figure 7:
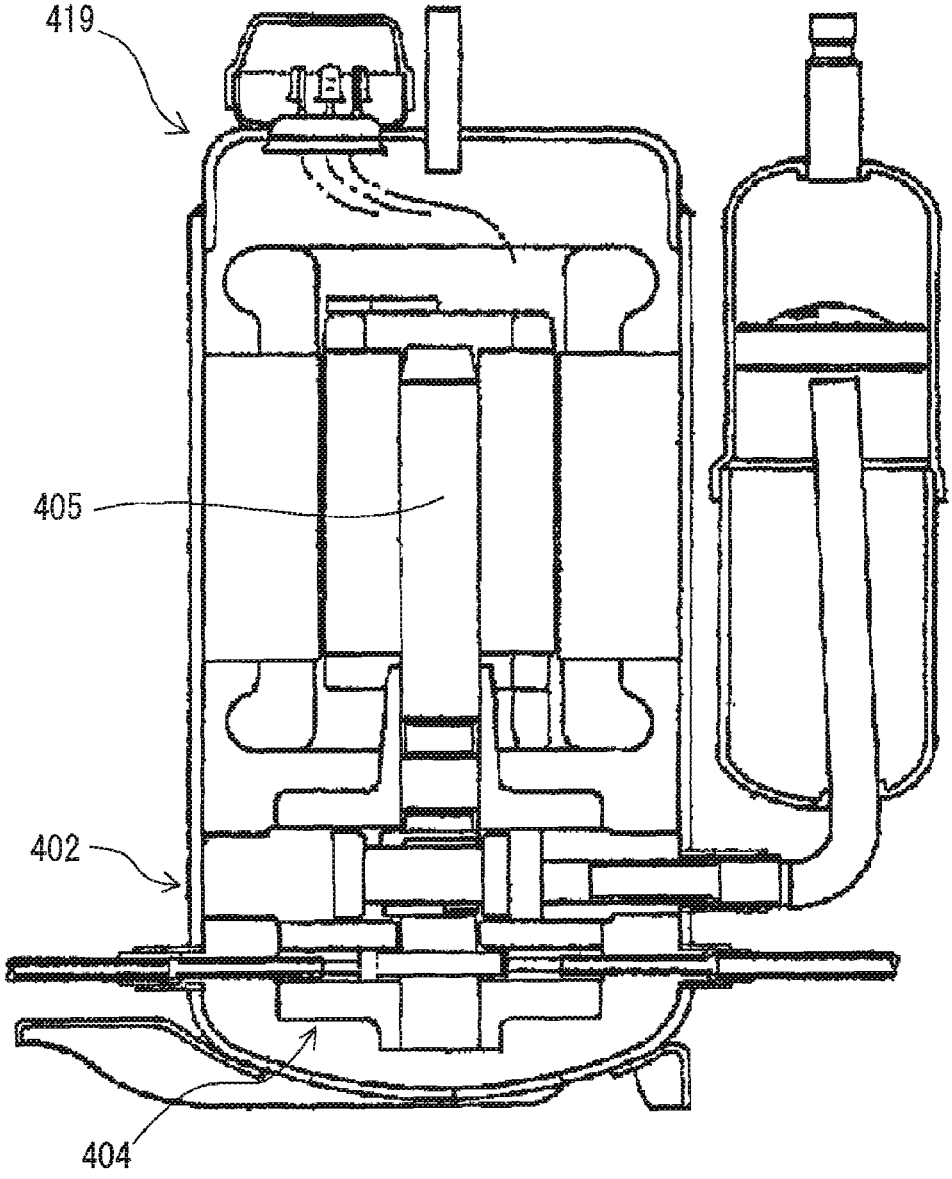
FIG. 7 is a schematic view of a conventional fluid machine.
Figure 8A:
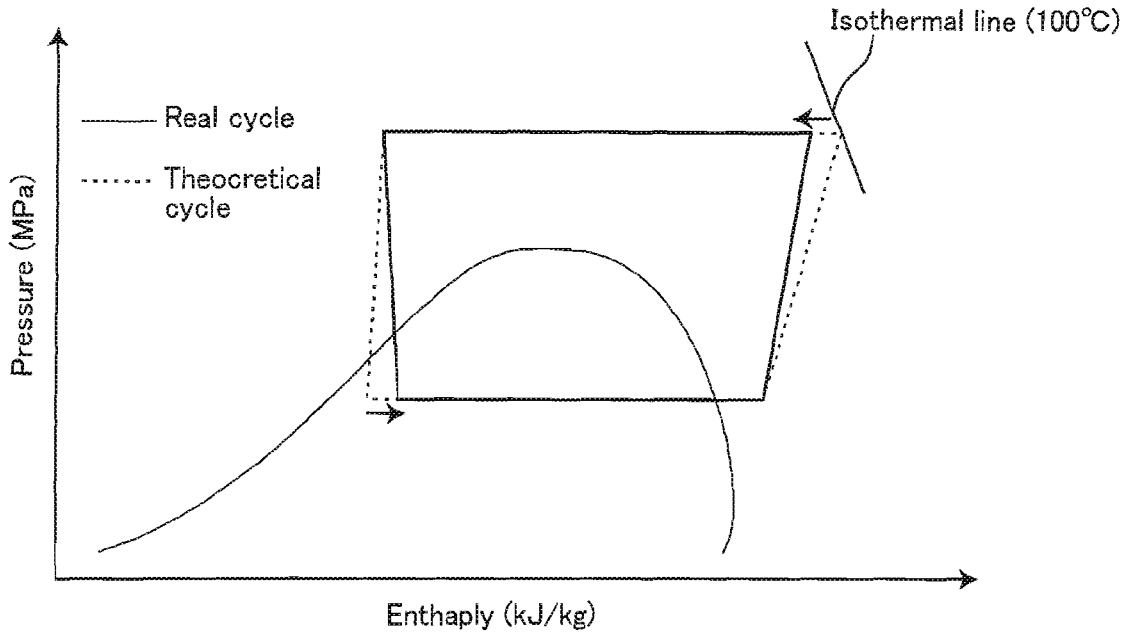
FIG. 8A is a Mollier diagram showing problems of a conventional refrigeration cycle apparatus.
Figure 8B:
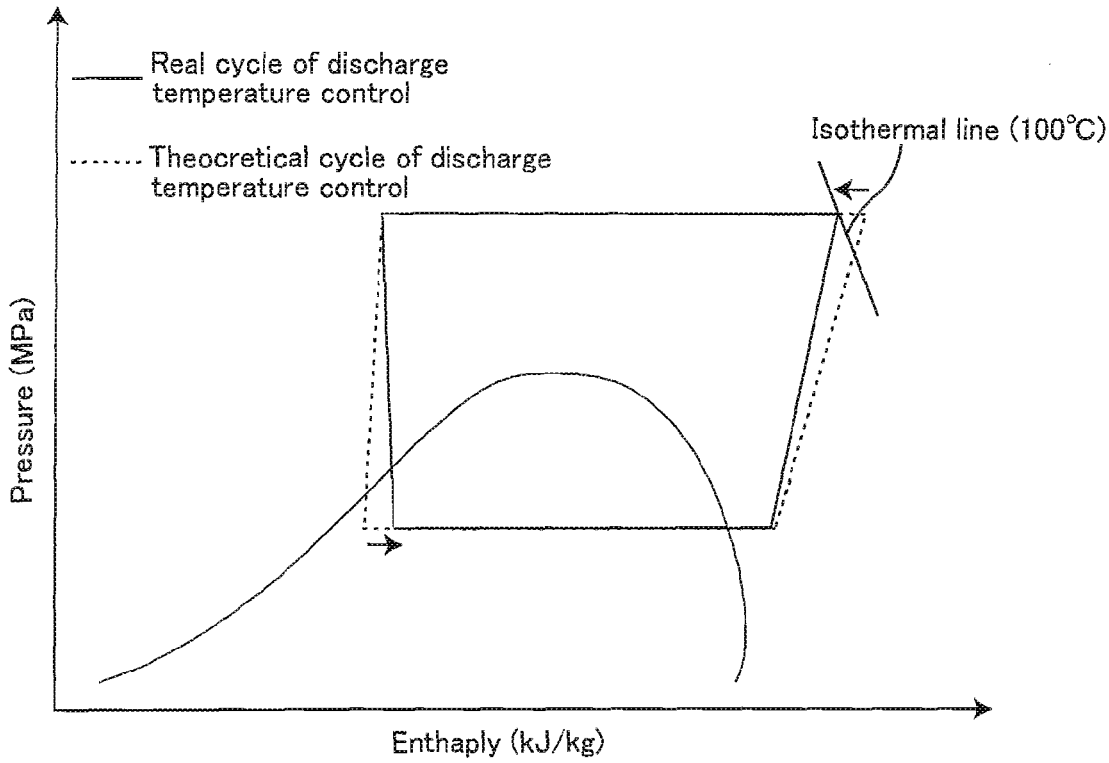
FIG. 8B is a Mollier diagram showing similar problems to those of FIG. 8A.
Figure 9:
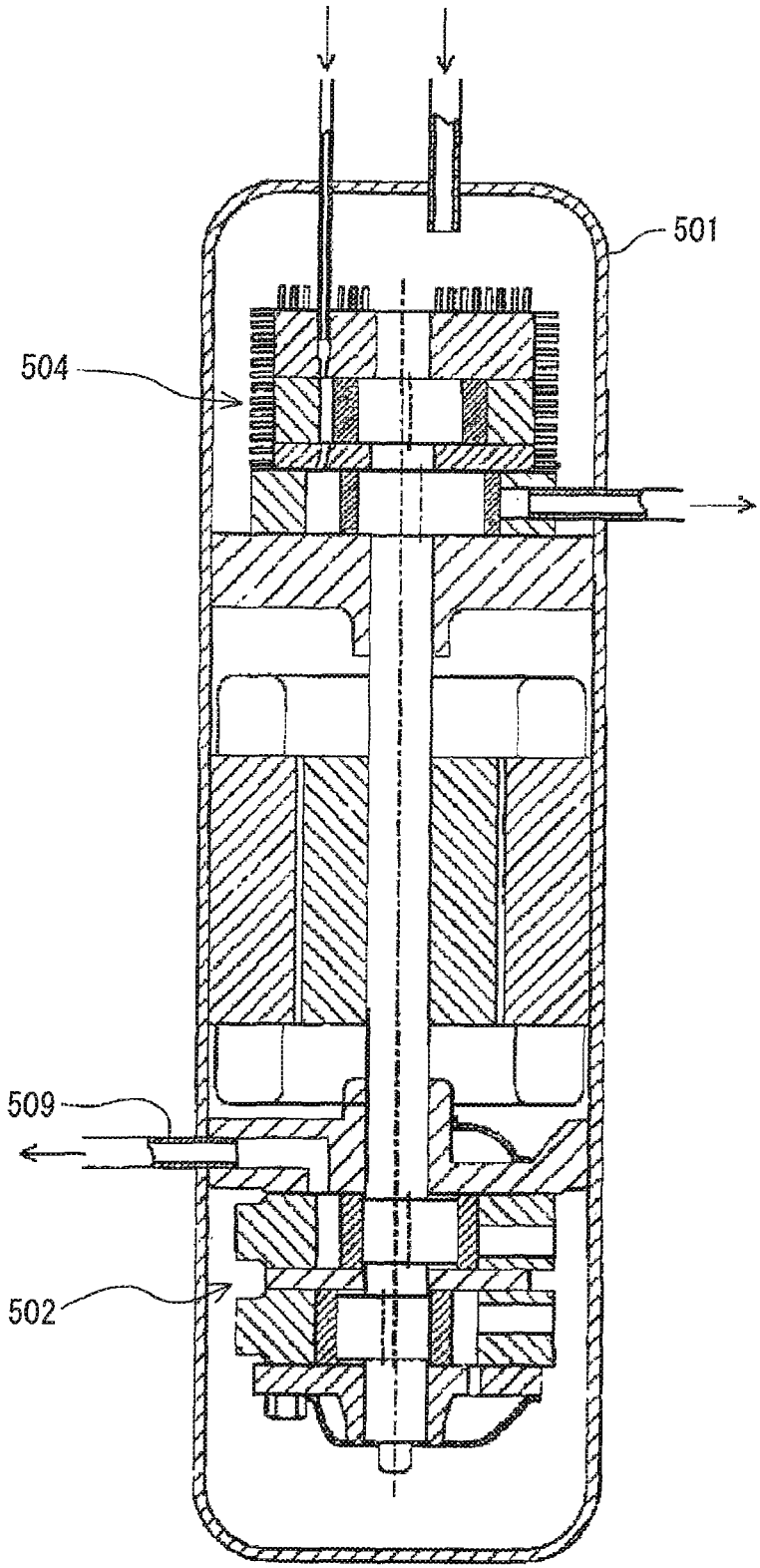
FIG. 9 is a schematic view of another conventional fluid machine.
Figure 10:
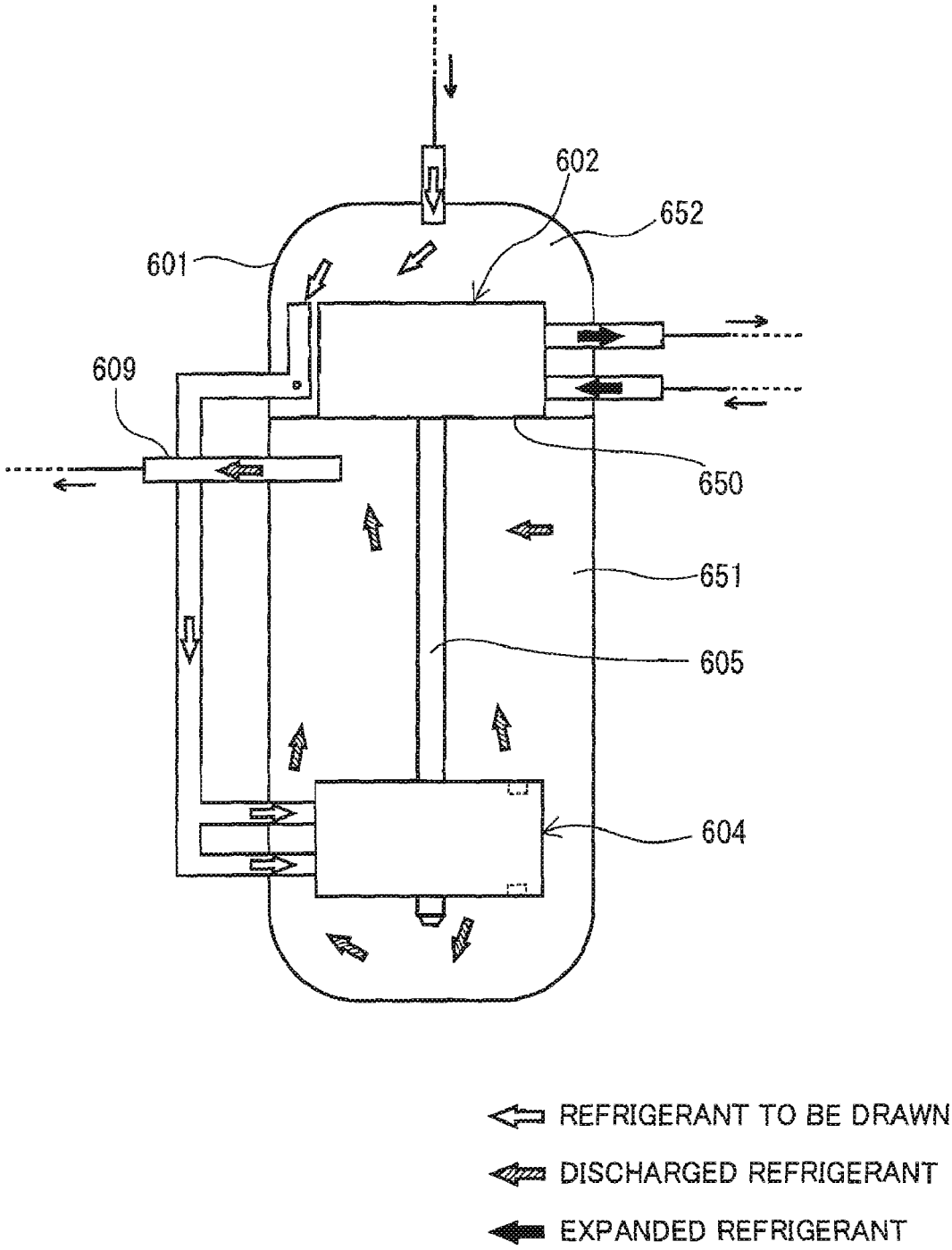
FIG. 10 is a schematic view of still another conventional fluid machine.

FIG. 6 is a vertical sectional view of another fluid machine that can be used suitably for the refrigeration cycle apparatus 100 of FIG. 1. As shown in FIG. 6, the basic configuration of a fluid machine 203 of the present embodiment is the same as that of the fluid machine described in the first embodiment.

The expansion mechanism 40 in the fluid machine 203 of the present embodiment is a rotary expansion mechanism including: rollers 26, 27 mounted on the shaft 5; cylinders 22, 24 in which the rollers 26, 27 are disposed; and a suction pipe 12 for guiding a refrigerant to be expanded to the expansion mechanism 4. The basic configuration of the rotary expansion mechanism is the same as described in the first embodiment.

As described in the second embodiment, the refrigerant passage space 7 through which the refrigerant to be drawn into the expansion mechanism 40 passes is formed of a jacket disposed around the expansion mechanism 40. In the present embodiment, such a jacket is formed of a cover member 42 for covering the cylinders 22, 24. The cover member 42 covers entirely the outer circumferential surfaces of the cylinders 22, 24 from the upper side (first side) to the lower side (second side) along the axis direction of the shaft 5 so as to form the refrigerant passage space 7 between the cover member 42 and the cylinders 22, 24.

The end portions of the cover member 42 are fixed to the upper bearing 21 and the closing plate 32 by welding, brazing, or the like so that the refrigerant and the oil in the internal space of the closed casing 1 is prevented from leaking into the refrigerant passage space 7. The suction pipe 12 penetrates the cover member 42 so that the refrigerant to be drawn into the expansion mechanism 40 can be supplied to the refrigerant passage space 7 formed inside the cover member 42.

As in the other embodiments, according to the present embodiment, the heat transfer from the refrigerant and the oil in the internal space of the closed casing 1 to the expansion mechanism 40 can be suppressed.

The invention claimed is:

1. A fluid machine comprising:

a compression mechanism for compressing a working fluid;

an expansion mechanism for expanding the working fluid and for recovering mechanical power from the expanding working fluid;

a shaft for coupling the compression mechanism and the expansion mechanism and for transferring the mechanical power recovered by the expansion mechanism to the compression mechanism; and a closed casing for accommodating the compression mechanism, the shaft and the expansion mechanism, and having an internal space into which the working fluid that has been compressed by the compression mechanism is discharged, wherein the expansion mechanism is a rotary expansion mechanism including: a roller mounted on the shaft; a cylinder in which the roller is disposed; and a suction pipe for guiding the working fluid to be expanded to the expansion mechanism, the cylinder is provided with a through-hole extending in an axis direction of the shaft between an expansion chamber in the cylinder and an outer circumferential surface of the cylinder, the through-hole having a larger flow passage area than that of the suction pipe, and the suction pipe, the through-hole, and a suction port opening to the expansion chamber are arranged in this order along a flow direction of the working fluid so that the working fluid that has flowed into the through-hole through the suction pipe flows from a first side to a second side of the axis direction and thereafter is drawn into the expansion chamber through the suction port.

2. The fluid machine according to claim 1, wherein a plurality of the through-holes are provided in the cylinder so that the through-holes have a larger flow passage area in total than that of the suction pipe.

3. The fluid machine according to claim 2, wherein the through-holes are provided circumferentially around the expansion chamber.

4. The fluid machine according to claim 2, wherein the expansion mechanism further includes: a branching passage for communicating the suction pipe and the through-holes, and formed on the first side of the axis direction so that the working fluid is guided from the suction pipe to each of the through-holes; and a merging passage for communicating the through-holes and the suction port, and formed on the second side of the axis direction so that the working fluid is merged after flowing through each of the through-holes and drawn from the suction port into the expansion chamber.

5. The fluid machine according to claim 4, wherein the expansion mechanism further includes a first closing member for closing the cylinder on the first side, the first closing member is provided with the branching passage, and the suction pipe is connected to the first closing member so that the working fluid can be supplied to the branching passage.

6. The fluid machine according to claim 5, wherein a part of the first closing member is in contact with the cylinder, the branching passage is constituted of a recessed portion formed in the part, and each of the through-holes faces the recessed portion of the first closing member.

7. The fluid machine according to claim 4, wherein the expansion mechanism further includes a second closing member for closing the cylinder on the second side, and the second closing member is provided with the suction port and the merging passage.

8. The fluid machine according to claim 2, wherein each of the through-holes has a larger flow passage area than that of the suction pipe.

9. A fluid machine comprising:

a compression mechanism for compressing a working fluid;

an expansion mechanism for expanding the working fluid and for recovering mechanical power from the expanding working fluid;

a shaft for coupling the compression mechanism and the expansion mechanism and for transferring the mechanical power recovered by the expansion mechanism to the compression mechanism; and a closed casing for accommodating the compression mechanism, the shaft and the expansion mechanism, and having an internal space into which the working fluid that has been compressed by the compression mechanism is discharged, wherein the expansion mechanism is a rotary expansion mechanism including: a roller mounted on the shaft; a cylinder in which the roller is disposed; and a suction pipe for guiding the working fluid to an expansion chamber formed between the roller and the cylinder, the cylinder is provided with a plurality of through-holes extending in an axis direction of the shaft between the expansion chamber and an outer circumferential surface of the cylinder, and the expansion mechanism further includes: a branching passage for communicating the suction pipe and the through-holes, and formed on a first side of the axis direction so that the working fluid is guided from the suction pipe to each of the through-holes; and a merging passage for communicating the through-holes and a suction port opening to the expansion chamber, and formed on a second side of the axis direction so that the working fluid is merged after flowing through each of the through-holes and drawn from the suction port into the expansion chamber.

10. A fluid machine comprising:

a compression mechanism for compressing a working fluid;

an expansion mechanism for expanding the working fluid and for recovering mechanical power from the expanding working fluid;

a shaft for coupling the compression mechanism and the expansion mechanism and for transferring the mechanical power recovered by the expansion mechanism to the compression mechanism;

a closed casing for accommodating the compression mechanism, the shaft and the expansion mechanism, and having an internal space into which the working fluid that has been compressed by the compression mechanism is discharged; and a jacket disposed around the expansion mechanism, the jacket forming, around the expansion mechanism, a space through which the working fluid to be drawn into the expansion mechanism passes.

11. The fluid machine according to claim 10, wherein:

the jacket includes a pipe having an internal space used as the space and wound in spirals around the expansion mechanism in such a manner that adjacent spiral portions of the pipe are in contact with each other; and the pipe also is used as a suction pipe for guiding the working fluid to be expanded to the expansion mechanism, and one end of the pipe extends outside the closed casing and the other end thereof is connected to the expansion mechanism.

12. The fluid machine according to claim 10, wherein:

the expansion mechanism is a rotary expansion mechanism including: a roller mounted on the shaft; a cylinder in which the roller is disposed; and a suction pipe for guiding the working fluid to be expanded to the expansion mechanism; and the jacket includes a cover member for covering entirely an outer circumferential surface of the cylinder from a first side to a second side in an axis direction of the shaft so that the space is formed between the jacket and the cylinder.

13. A refrigeration cycle apparatus comprising the fluid machine according to claim 1, claim 9, or claim 10.

* * * * *